United States Patent [19]

Ward

[11] 4,102,092

[45] Jul. 25, 1978

[54] VENTING DEVICE

[76] Inventor: Bruce K. Ward, 2904 Virginia Ave., St. Louis Park, Minn. 55426

[21] Appl. No.: 787,744

[22] Filed: Apr. 15, 1977

[51] Int. Cl.[2] ..... E04B 7/18

[52] U.S. Cl. ..... 52/92; 52/95; 98/37; 98/42 A

[58] Field of Search ..... 52/92, 95, 198, 199, 52/303; 98/32, 37, 42; D23/139, 151, 153, 163

[56] References Cited

U.S. PATENT DOCUMENTS

| | | | |
|---|---|---|---|
| 1,523,970 | 1/1925 | Jakob | 52/407 |
| 2,283,257 | 5/1942 | Jorsch | 52/407 X |
| 2,318,820 | 5/1943 | Voigt et al. | 52/303 |
| 2,477,152 | 7/1949 | Stevenson | 52/199 X |
| 3,160,987 | 12/1964 | Pinkley | 52/407 X |
| 3,186,524 | 6/1965 | Spaeth, Jr. | 52/630 X |
| 3,236,170 | 2/1966 | Meyer et al | 52/22 X |
| 3,240,144 | 3/1966 | Lind | 98/42 X |
| 3,683,785 | 8/1972 | Grange | 52/92 X |
| 3,863,553 | 2/1975 | Koontz | 52/95 X |
| 3,972,164 | 8/1976 | Grange | 52/92 X |

FOREIGN PATENT DOCUMENTS

| | | | |
|---|---|---|---|
| 558,814 | 6/1958 | Canada | 52/303 |

*Primary Examiner*—Alfred C. Perham
*Attorney, Agent, or Firm*—Burd, Braddock & Bartz

[57] ABSTRACT

A venting device providing an air vent passage between the soffit space and attic space of a structure and a baffle for retaining insulation material in the attic. The venting device has a generally V-shaped body forming with the roof an air vent passage leading from the soffit space to the attic space. The V-shaped body is located between adjacent roof rafters with an air vent passage leading from the soffit space to the attic space. The V-shaped body is located between adjacent roof rafters with flanges on opposite sides of the body that engage the roof boards and the adjacent roof rafters. The forward end of the body has foldable baffles that close the space between the sill plate and the roof boards leaving the passage formed by the V-shaped body open so that the insulation material in the attic does not block the soffit and passage between soffit space and attic space.

46 Claims, 4 Drawing Figures

VENTING DEVICE

BACKGROUND OF INVENTION

Soffit vents are used to allow air to flow through the attic so that moisture and hot air can be removed from the attic. When the soffit air passage is blocked by insulation or other structures inadequate attic ventilation causes condensation in the attic with resultant moisture accumulation in the attic insulation material. This reduces the insulating effectiveness of the insulation and may cause damage to the interior of the structure.

The increased cost of fuel has caused an increased use of insulation materials in the attics of structures, such as homes. Fiber and foamed plastic insulation materials are blown into the crawl or attic space below the roof and between the ceiling joist. Matt-type insulation material is also used. Poor air circulation can result when the spaces between the roof joist above the sill plate are closed. Vent structures have been used to insure flow of air from the soffit spaces to the attic spaces structures. Examples of vent structures are disclosed in the following prior art.

PRIOR ART

U.S. Pat. No. 27,872 Walcott
U.S. Pat. No. 2,318,820 Voigt et al
U.S. Pat. No. 2,477,152 Stevenson
U.S. Pat. No. 2,601,905 Anderegg
U.S. Pat. No. 2,641,449 Antony
U.S. Pat. No. 2,969,726 Bottom
U.S. Pat. No. 3,196,773 Lorenz et al
U.S. Pat. No. 3,236,170 Meyer et al
U.S. Pat. No. 3,240,144 Lind
U.S. Pat. No. 3,633,659 Ohlsson
U.S. Pat. No. 3,863,553 Koontz
U.S. Pat. No. 3,683,785 Grange

SUMMARY OF INVENTION

The invention is directed to a vent device providing an air passage and insulation baffle between the roof and top wall plate of a structure so that air can flow from the soffit space to the attic space of a structure. The vent device is a one-piece foldable sheet member having a body means forming an elongated passage for carrying air from the soffit space to the attic space. The body means has panels arranged in a general V-shape. Longitudinal flanges are located along opposite edges of the body. The flanges are adapted to engage the roof boards and adjacent roof rafters to hold the body in a generally V-shaped position. Baffle or head structure is located at the forward end of the body. The baffle folds to a generally normal position with respect to the body when the body is folded to its V-shaped position. Rearwardly directed lips located on the lower edges of the baffle engage the plate when the vent device is properly positioned on the plate and attached to the roof boards.

An object of the invention is to provide a vent device usable between adjacent roof rafters and the plate to form an air vent passage between the soffit space and attic space of a structure to insure movement of air through the attic space. A further object of the invention is to provide a low cost one-piece vent device having a pair of angularly oriented panels forming an air passage and a baffle to close the space adjacent the passage between the plate and the roof boards to prevent movement of insulation into the soffit space of a structure. A further object of the invention is to provide a vent device having a structural shape that does not collapse when subjected to external forces in conjunction with a baffle that permits insulation material to be placed adjacent the sill plate and prevents the insulation material from moving into the soffit area of the structure. Yet another object of the invention is to provide a vent device that is made and shipped in a flat form and is folded into a usable shape at the location of use or job site. An additional object of the vent is to provide a baffle at the plate that prevents blow back of insulation due to strong and gusty winds.

IN THE DRAWINGS

FIG. 5 is a sectional view taken along the line 3—3 of FIG. 2; and

DETAILED DESCRIPTION

Figure 1:
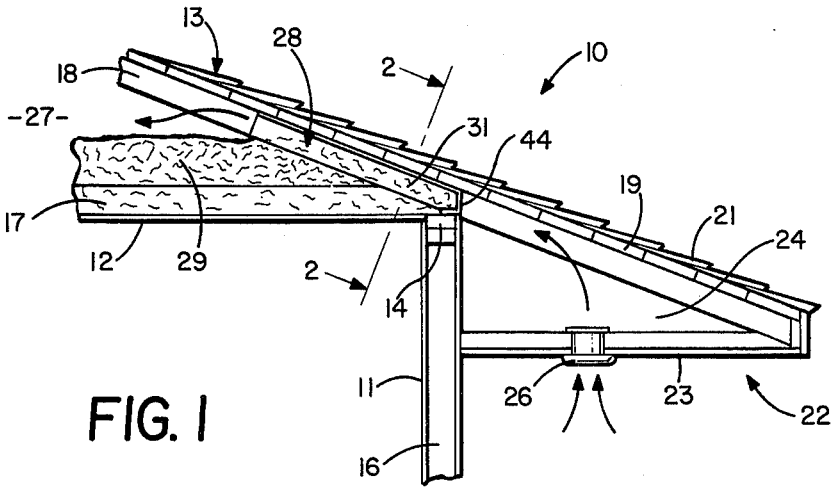
FIG. 1 is a sectional side elevational view of a portion of a structure provided with a vent device of the invention.
Figure 2:
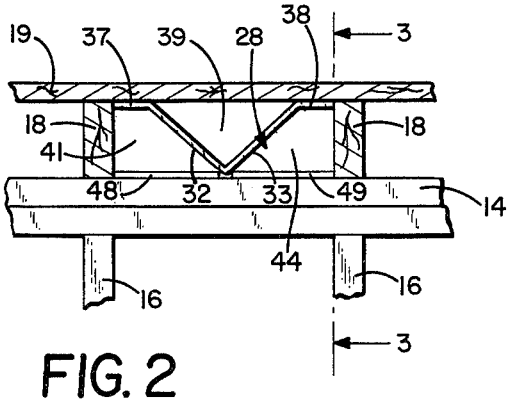
FIG. 2 is an enlarged sectional view taken along the line 2—2 of FIG. 1.

Referring to FIG. 1, there is shown a structure indicated generally at 10 such as a house, garage, shed, barn, or the like. Structure 10 has an upright side wall 11 carrying a generally horizontal ceiling 12. Side wall 11 and ceiling 12 are covered with a downwardly sloping roof 13. Side wall 11 has a top stud or wall plate 14 supporting the ceiling and the roof. Upright studs 16 in wall 11 support plate 14. A plurality of horizontal ceiling joists 17 extend across the ceiling and are supported on plate 14. Roof 13 has a plurality of upwardly extended roof rafters 18. Roof boards 19 are secured to roof rafters 18. Shingles 21 or suitable roofing is attached to the roof boards 19. Roof 13 extends laterally away from wall 11 to form an overhang section 22. The bottom of overhang section 22 is closed with a generally horizontal wall 23 to enclose the soffit space 24. A soffit ventilator 26 is located in the wall 23 to insure the movement of air through the soffit space 24 into the attic 27 or crawl space between ceiling 12 and roof 13. A plurality of soffit ventilators are used to insure the movement of air through the soffit space 24.

A vent device indicated generally at 28 is located between adjacent roof rafters 18 to provide an air passage 39 between the soffit space 24 and attic space 27. Vent device 28 also serves as a baffle or dam to retain the insulation material 29 above ceiling 12. The insulation material 29 can also be positioned in the attic space adjacent the plate 14 to insure insulation. Insulation material 29 can be the blown plastic material, vermiculite or glass fiber material. The insulation material can be from 6 to 24 or more inches (15 to 60 cm.) thick.

Figure 4:
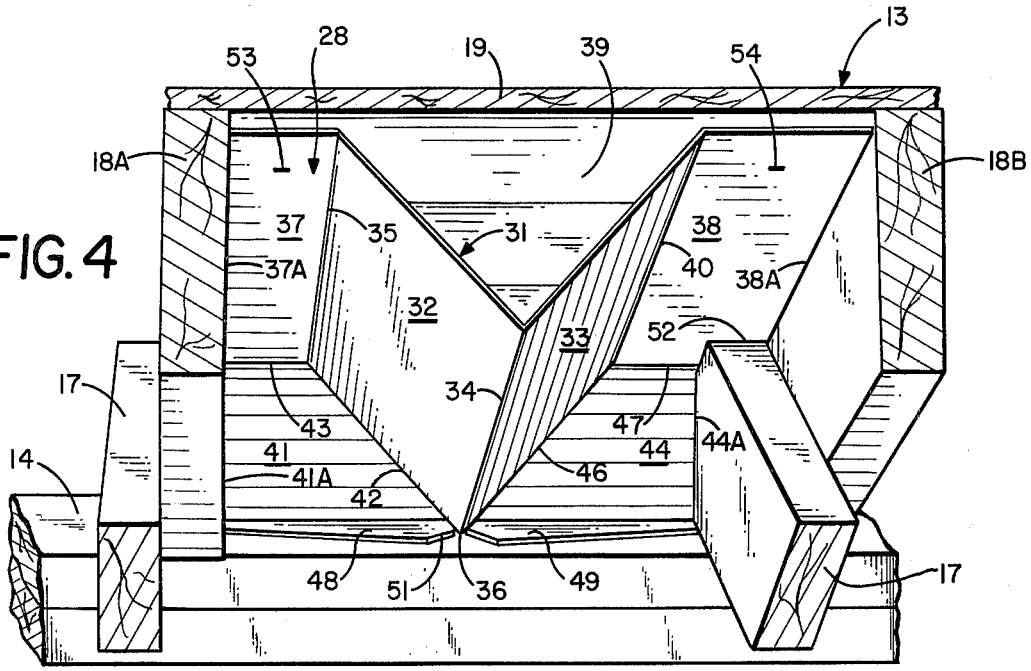
FIG. 4 is a perspective view of the vent device located between adjacent roof rafters to form an air passage from the soffit space to the attic space of the structure.

Referring to FIG. 4, vent device 28 has a generally V-shape body comprising a pair of rectangular panels 32 and 33. The panels 32 and 33 are secured together along an apex or longitudinal fold line 34. The forward end or corner 36 of body 31 engages the top of the plate 14. A first longitudinal side flange 37 is integral with the upper end of panel 32. A fold line 35 separates panel 32 from flange 37. Flange 37 has an outside edge 37A that engages the roof rafter 18A. A second flange 38 is integral with the upper edge of panel 33. A fold line 40 is longitudinally located between panel 33 and flange 38.

Flange 38 has an outer linear edge 38A engageable with roof rafter 18B. Body 31 forms an air vent passage 39 with the inside of roof boards 19. Passage 39 leads from the upper portion of the soffit space 24 to attic space 27. As shown in FIG. 1, air flows through the soffit ventilator 26, soffit space 24, and passage 39 of vent device 28 into attic space 27. Conventional ventilators, exhaust fans and like apparatus are used to move air from the attic space to the outside environment.

A pair of baffles 41 and 44 are hingedly joined to the forward end of body 31. Baffle 41 is joined to the forward end of panel 32. A fold line 42 separates panel 32 from baffle 41. A slit 43 separates the adjacent edges of flange 37 and baffle 41. The lower edge of baffle 41 has a rearwardly directed lip or tab 48 that rests on the top of plate 14.

The second baffle 44 is integral with the forward edge of panel 33. A fold line 46 is located between panel 33 and baffle 44. The adjacent edges of flange 38 and baffle 47 have a lateral slit 47. The lower edge of baffle 44 has a rearwardly directed lip or tab 49. Lip 49 rests on the top of plate 14. An opening or slit 51 is located between the adjacent portions of baffle flanges 48 and 49. The baffle 41 has an outer edge 41A located in engagement with the roof rafter 18A. Baffle 44 has an outer edge 44A in engagement with ceiling joist 17. Flange 38 has a cut-out section providing stop 42 located in engagement with the ceiling joist 17.

Vent device 28 is a one-piece sheet member that is scored along the fold lines. The flanges 37 and 38 are defined from the baffles 41 and 44 by score lines or a series of rectangular slits. Baffles 41 and 44 are separated from each other with a longitudinal center score or spaced slits. The score lines can be compressed longitudinal portions of the sheet member or intermittent perforations of the sheet member. The sheet member can be a cellulose fiber board coated with a water-resistant adhesive and paraffin material. The fiber board can also be treated with flame-retardant materials. Other types of materials as flexible sheet foam plastic, sheet metal, aluminum, or wood, can be used for the vent device. In use, vent device 28 is made from flat sheet material and shipped in flat form to the job site. At the job site the vent device 28 is formed into a general V-shape. This is accomplished by first hand folding the baffles 41 and 44 along fold lines 42 and 46 respectively to position the baffles in a generally normal location with respect to the plane of the body panels 32 and 33. The panels 32 and 33 are then hand folded along the longitudinal center fold line 44 to form the generally V-shaped body 31. The V-shape of body 31 provides a convenient and manipulatable shape for the installer. The vent device 28 is slipped between roof rafters 18A and 18B. Vent device 28 is then moved down until the lips 48 and 49 are in firm engagement with the top of plate 14. The flanges 37 and 38 engage the bottom of roof boards 19. The flange 38 has a stop edge 42 which contacts the ceiling joist 19. The upper edges of the baffles 41 and 44 are located in engagement with the roof boards 19 so that baffles 41 and 44 are in a tight wedging engagement between the roof boards 19 and sill plate 14. The forward end 36 of the body 36 also rests on the top of plate 14. The opposite edges 37A and 38A of flanges 37 and 38 engage the adjacent or inside surfaces of the roof rafters 18A and 88B. Flanges 37 and 38 are in flat surface contact with the roof boards 39. Staples 53 and 54 or similar fastening means hold the flanges 37 and 38 in engagement with the roof boards 19.

The V-shaped body 31 provides the vent device with stability and strength as it prevents folding and collapsing of the body. The fold angle of body 31 can be changed so that the vent can be used with structures having different spacings between adjacent roof rafters. The baffles in conjunction with the V-shaped body allows the use of more insulation material at the area adjacent the plate without blocking the vent passage or allowing insulation material in the soffit space.

While there has been shown and described a preferred embodiment of the venting device of the invention, it is understood that changes in the materials, shape, structure may be made by those skilled in the art without departing from the invention. The invention is defined in the following claims.

The embodiment of the invention in which an exclusive property or privilege is claimed are defined as follows:

1. A vent device used to provide an air vent passage between the soffit space and attic space of a structure, said structure having a plate, laterally spaced roof rafters, and roof structure attached to the rafters, said roof structure being spaced from the plate comprising: a one-piece sheet member having at least one generally V-shaped body locatable between adjacent roof rafters forming with the inside of the roof structure an air vent passage between the soffit space and attic space, said body having a first portion engageable with the plate and second portions engageable with the roof structure, and baffle means attached to one end of the body locatable between and engageable with the roof structure and plate to close the space between the plate and roof structure without closing the air vent passage.

2. The vent device of claim 1 wherein: the body includes two elongated flat panels angularly located relative to each other.

3. The vent device of claim 2 including: an elongated flat flange attached to the outer edge of each panel.

4. The vent device of claim 3 wherein: each flange has an outer edge adapted to engage a roof rafter.

5. The vent device of claim 1 including: an elongated flat flange attached to each outer edge of the V-shaped body.

6. The vent device of claim 5 wherein: each flange has an outer edge adapted to engage a roof rafter.

7. The vent device of claim 1 wherein: the baffle means includes two baffles connected to said one end of the body.

8. The vent device of claim 7 including: a lip on each baffle engagable with the plate.

9. The vent device of claim 1 wherein: the body has two elongated flat panels angularly located relative to each other, said baffle means having two generally flat baffles, one of said baffles being foldably connected to one end of one panel and the other of said baffles being foldably connected to one end of the other panel.

10. The vent device of claim 9 including: a lip foldably connected to each baffle, each lip being engagable with the sill plate.

11. The vent device of claim 9 including: an elongated flat flange attached to the outer edge of each panel.

12. The vent device of claim 11 wherein: each flange has an outer edge adapted to engage a roof rafter.

13. The vent device of claim 11 wherein: one flange and panel have a cut out to accommodate a ceiling joist.

14. The vent device of claim 9 wherein: elongated folding means hingedly connects the panels to each other.

15. A vent device used to provide an air vent passage between the soffit space and attic space of a structure, said structure having a plate, laterally spaced roof rafters, and roof structure attached to the rafters, said roof structure being spaced from the plate comprising: a one-piece member having body means forming with the inside of the roof structure an air vent passage between the soffit space and attic space, said body means having outer edges, a first outwardly directed flange connected to one outer edge of the body means engageable with the roof structure, a second outwardly directed flange connected to the other edge of the body means engageable with the roof structure, said body means and first and second flanges being locatable between adjacent roof rafters, said body means having an end with a portion thereof locatable in engagement with said plate, whereby the body means is held between the roof structure and plate, and baffle means attached to said end of the body means, said baffle means being locatable between the roof structure and the plate to close the space between the plate and the roof structure without closing the air vent passage.

16. The vent device of claim 15 wherein: each flange has an outer edge adapted to engage a roof rafter.

17. The vent device of claim 15 wherein: the baffle means includes two baffles connected to said one end of the body means.

18. The vent device of claim 17 including: a lip on each baffle engagable with the plate.

19. The vent device of claim 15 wherein: said body means has at least two elongated flat panels angularly located relative to each other, said baffle means having two generally flat baffles, one of said baffles being foldably connected to one end of one panel and the other said baffles being foldably connected to one end of the other panel.

20. The vent device of claim 19 including: a lip foldably connected to each baffle, each lip being engagable with the plate.

21. The vent device of claim 19 wherein: an elongated folding means hingedly connects the baffles to the panels.

22. The vent device of claim 15 wherein: said body means has at least two elongated flat panels angularly located relative to each other to form said air vent passage with the roof structure.

23. The vent device of claim 22 including: an elongated folding means hingedly connecting said panels to each other.

24. A vent device used to provide an air passage between the soffit space and the attic space of a structure comprising: a one-piece sheet member having a pair of elongated generally flat panels, first folding means longitudinally connected said panels whereby said panels can be angularly moved relative to each other to form a generally V-shaped body, each of said panels having an end, a first baffle located adjacent said end of one panel, second folding means hingedly connecting the first baffle to said end of one panel, a second baffle located adjacent the end of the other panel, and third folding means connecting second panel to said end of the other panel and flange means hingedly connected to the side of one panel.

25. The vent device of claim 24 wherein: the flange means comprises an elongated flange located adjacent one panel, and fourth folding means hingedly connecting said flange to said one panel.

26. The vent device of claim 25 including: a second flange located adjacent the other panel, and fifth folding means hingedly connecting the second flange to said other panel.

27. The device of claim 24 including: a first lip located adjacent the first baffle, means hingedly connecting the first said lip to said first baffle, a second lip located adjacent the second baffle, and means hingedly connected the second lip to the second baffle.

28. A vent device used to provide an air vent passage between the soffit space and attic space of a structure, said structure having a plate, laterally spaced roof rafters, and roof structure attached to the rafters and spaced from the plate comprising: a one-piece sheet member having at least one generally V-shaped body used to provide with the inside roof structure an air vent passage between the soffit space and the attic space, said body having a portion engageable with the plate, elongated outer edges, outwardly directed flange means connected to one outer edge of the body engageable with the roof structure, said body and flange means being locatable between adjacent roof rafters and extended from the plate into the attic space to provide the air vent passage between the soffit space and attic space, and baffle means attached to one end of the body, said baffle means locatable between and engageable with the roof structure and plate to close the space between the plate and roof structure without closing the air vent passage.

29. The vent device of claim 28 including: second outwardly directed flange means connected to the other outer edge of the body engageable with the roof structure.

30. The vent device of claim 29 wherein: each flange means has an elongated linear edge adapted to engage a roof rafter.

31. The vent device of claim 29 wherein: elongated folding means connects each flange means to the body.

32. A vent device used to provide an air vent passage between the soffit space and attic space of a structure, said structure having a plate, laterally spaced roof rafters, and roof structure attached to the rafters, said roof structure being spaced from the plate comprising: a sheet member having a body locatable between adjacent roof rafters forming with the inside of the roof structure an air vent passage between the soffit space and attic space, said body having portions engageable with the roof structure, and baffle means attached to one end of the body locatable between the body and engageable with the plate whereby the body and baffle means are wedged between the plate and roof structure to close the space between the plate and body without closing the air vent passage.

33. The vent device of claim 32 wherein: the body includes two elongated flat panels angularly located to each other.

34. The vent device of claim 33 including: an elongated flat flange attached to the outer edge of each panel, each flange being engageable with the roof structure.

35. The vent device of claim 24 wherein: each flange has an outer edge adapted to engage a roof rafter.

36. The vent device of claim 32 wherein: the portions of the body are elongated flat flanges attached to each outer edge of the body.

37. The vent device of claim 36 wherein: each flange has a portion adapted to engage a roof rafter.

38. The vent device of claim 34 wherein: the baffle means includes two baffles connected to said one end of the body.

39. The vent device of claim 38 including: a lip on each baffle engageable with the plate.

40. The vent device of claim 32 wherein: the body has two elongated flat panels angularly located relative to each other, said baffle means having two generally flat baffles, one of said baffles being foldably connected to one end of one panel and the other of said baffles being foldably connected to one end of the other panel.

41. The vent device of claim 40 including: a lip foldably connected to each baffle, each lip being engageable with the sill plate.

42. The vent device of claim 40 including: an elongated flat flange attached to the outer edge of each panel.

43. The vent device of claim 42 wherein: each flange has an outer edge adapted to engage a roof rafter.

44. The vent device of claim 42 wherein: one flange and panel have a cut out to accommodate a ceiling joist.

45. The vent device of claim 40 wherein: elongated folding means hingedly connects the panels to each other.

46. The vent device of claim 32 wherein: the body has a lower portion engageable with the plate whereby the body and baffle means can be wedged between the plate and roof structure.

* * * * *

UNITED STATES PATENT AND TRADEMARK OFFICE

CERTIFICATE OF CORRECTION

PATENT NO. : 4,102,092

DATED : July 25, 1978

INVENTOR(S) : Bruce K. Ward

Figure 3:
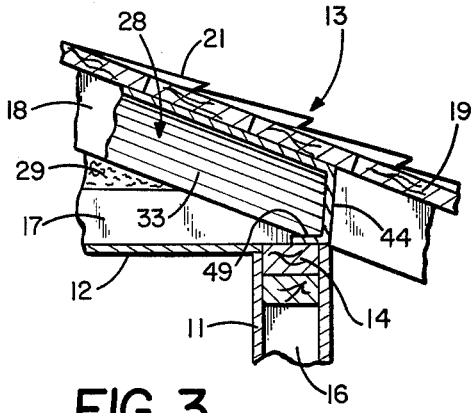

It is certified that error appears in the above-identified patent and that said Letters Patent are hereby corrected as shown below:

Column 2, line 19, "FIG. 5" should be -- FIG. 3 --.

Column 5, line 57, "connected" should be -- connecting --.

Column 6, line 11, "connected" should be -- connecting --.

Column 6, line 58, after "located" insert -- relative --.

Column 6, line 64, "Claim 24" should be -- Claim 34 --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*